United States Patent [19]

Ristvedt et al.

[11] 4,098,280

[45] Jul. 4, 1978

[54] COIN HANDLING MACHINE

[76] Inventors: Victor G. Ristvedt, Rte. 6; Roy B. Johnson, Rte. 6, Belmar Cir., both of Manchester, Tenn. 37355

[21] Appl. No.: 735,060

[22] Filed: Oct. 22, 1976

[51] Int. Cl.[2] ..... G07D 3/00

[52] U.S. Cl. ..... 133/3 A; 133/8 R

[58] Field of Search ..... 271/167–169; 209/97, 100, 103–105; 133/1 R, 3 R, 3 A, 8 R; 198/392

[56] References Cited

U.S. PATENT DOCUMENTS

| | | | |
|---|---|---|---|
| 1,979,659 | 11/1934 | Zierick | 133/3 R |
| 2,231,642 | 2/1941 | Seemel | 133/8 R |
| 2,906,276 | 9/1959 | Blanchette et al. | 133/3 R |
| 3,771,538 | 11/1973 | Reis | 133/8 R |

*Primary Examiner*—Robert B. Reeves

*Assistant Examiner*—H. Grant Skaggs

*Attorney, Agent, or Firm*—C. A. Phillips

[57] ABSTRACT

A coin sorting machine in which coins are fed onto the center of a rotating disc having a flexible surface. An annular guide plate is positioned over the disc, being open in the center for receiving coins, and extending outward to the peripheral edge of the disc. The underside of the guide plate is formed with a peripheral stop extending around approximately half of the disc, and a series of discrete radial guides extend over portions of the other half of the disc. The first of the series of guides would have an outer edge differing in radius from the peripheral stop by the diameter of the smallest coin to be sorted, and each succeeding guide would have a progressively smaller radial outside edge defined by the difference between coins to be sorted by succeeding guides.

6 Claims, 10 Drawing Figures

COUNTER
COUNTER

COIN HANDLING MACHINE

BACKGROUND OF THE INVENTION

1. Field of the Invention

This invention relates to coin handling machines employing a rotating disc for sorting and verifying coins.

2. General Description of the Prior Art

The denominational sorting of coins is a substantial chore for handlers of coins, particularly banks and vending machine companies. In view of the tremendous volume of coins which are sorted, it is quite obvious that for a machine to adequately meet their needs, the machine must be capable of high-speed operation. Further, it must be tolerant to a variation of coin thicknesses and be relatively jam-proof. With respect to speed, sorting speeds of known devices are in the range of 1,500 to 2,500, and at this time, the applicants have been advised that much higher speeds, ideally in the range of 6,000 to 8,000, are much needed. Ideally, coin verifiers, devices for verifying the number of coins in a container, should operate at speeds substantially higher than possible with existing devices, which it is believed operate in a range up to about 10,000 coins per minute.

An object of the present invention is to provide a coin sorter of simpler construction than previously existed and to provide a coin verifier with much increased speed, speed in the range upward to 20,000 coins per minute.

SUMMARY OF THE INVENTION

In accordance with this invention, a guide plate is positioned over a rotating disc having a flexible, generally flat, surface, the spacing between the two being generally that of the thickest coin to be handled. A series of lands extend down to the surface of the disc, forming a series of guide means to control coin movement. A first guide means includes an annular-shaped land or guide having an inward facing shoulder extending part way around the disc and inboard of the periphery of the disc, it functioning to receive coins moved by centrifugal force from the center of the disc outward and to initially form the coins in a generally circular single file. A second guide means employs a peripheral limit and stabilizing guide, and this guide means extends around a part of the disc which does not circumferentially border the first guide means. The stabilizing effect is achieved by a guide being tapered downward with increasing radial dimension to thus form an interfacing edge, whereby coins are wedged between this guide and the flexible surface of the disc as they are rotated. A third guide means consists of a passageway between the first and second guide means, and this passageway is generally along a line normal to a radial line. In the case of a coin sorter, coin release guide means are included which have a series of coin release guides which commence at an operating end of the second guide means, each successive coin release guide having an outer release radius progressively smaller than the radius of the preceding guide by the difference in diameter of coins to be released by successive guides. Where they appear, leading edges of the guide means are tapered so that a coin striking a leading edge will not be stopped by the leading edge, but will be depressed into the flexible surface and captured, and the coin will be caused to rotate at a fixed radial distance until it is no longer depressed by that guide means, whereby a captured coin will either be released by a coin release or rotated back into the center region of the disc, enabling it to be repositioned on an inner facing shoulder of the first guide means, and thereafter positioned in a single file.

DETAILED DESCRIPTION OF THE DRAWINGS

Figure 1:
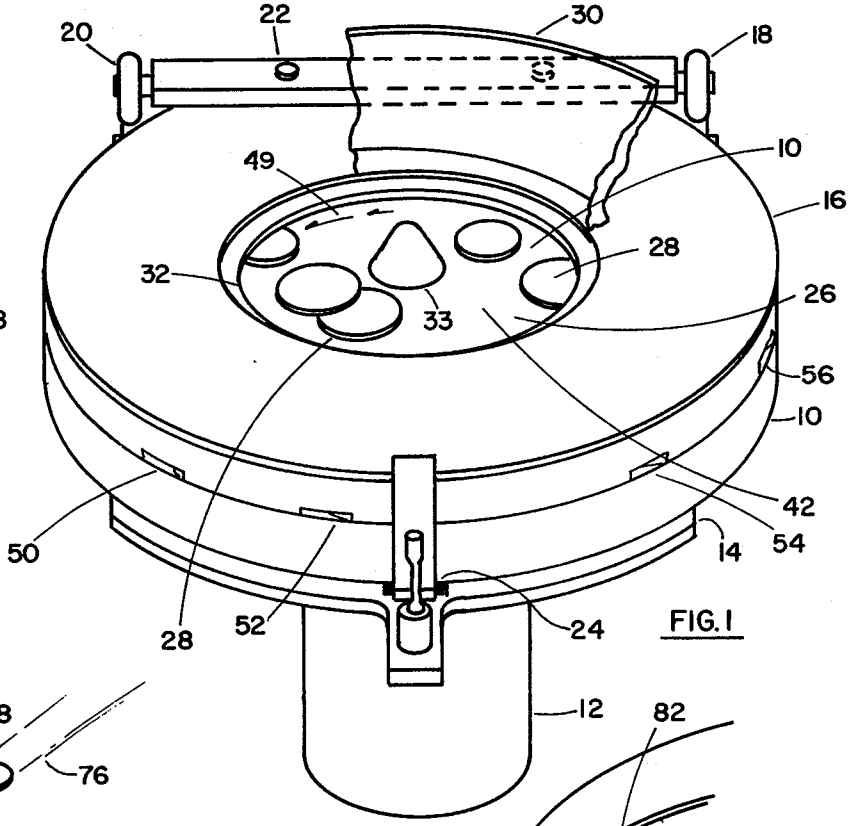
FIG. 1 is a pictorial view of an embodiment of this invention.

Referring to FIG. 1, a rotating disc 10 of approximately 8 to 20 inches in diameter is driven by motor 12, both being supported by a base 14. A top guide plate 16 is supported by a three-point mounting assembly, being pivotally mounted on base 14 by pivot mounts or supports 18 and 20 through mounting bar 22 and by latchable support 24. Thus, guide plate 16 may be opened back by unlatching latch support 24, whereby guide plate 16 would pivot about supports 18 and 20 and may be moved to a vertical position, exposing the top surface of disc 10. Disc 10 has a pliable or flexible surface 26 as may be provided by rubber pad 27 of approximately .1 to .6 inch in thickness. This pad, supported on plate 29 of disc 10, would typically have a resilience of 6 to 10 durometers. Coins 28 are supplied to the sorter through a hopper 30 which extends from opening 32 in guide plate 16. Hub 33 dispenses coins from the center of the disc.

Figure 2:
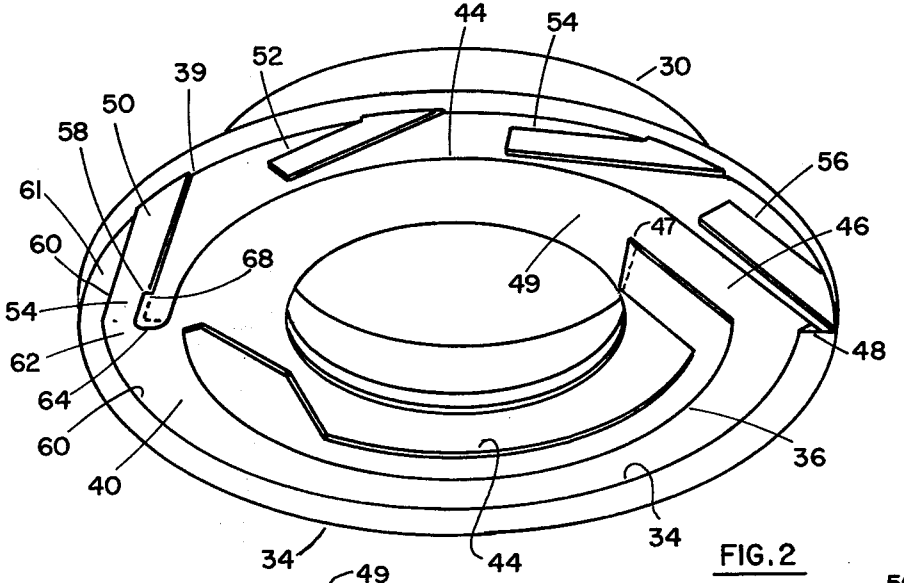
FIG. 2 is a pictorial view of a top guide plate for controlling the movement of coins as comtemplated by this invention.
Figure 3:
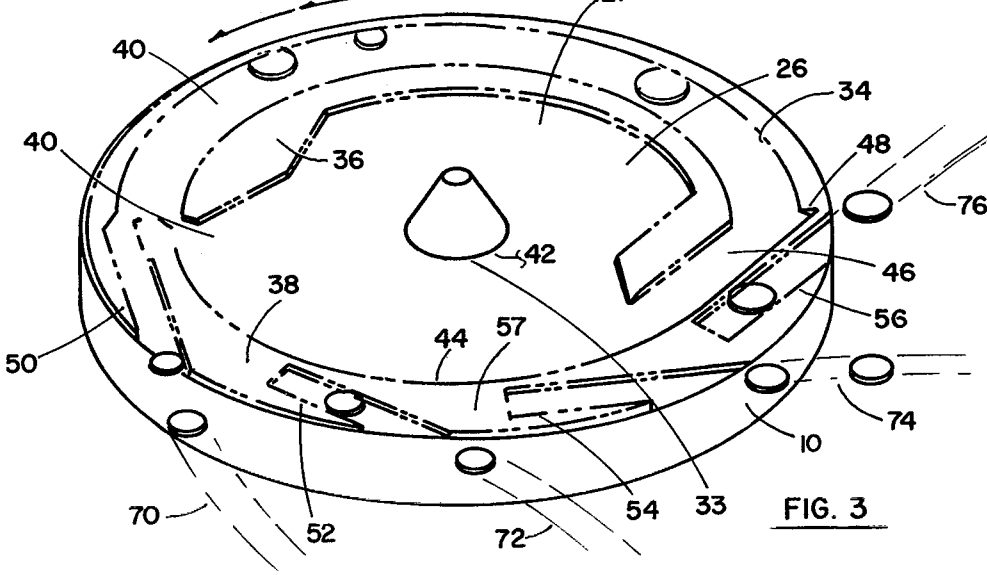
FIG. 3 is a pictorial view of the rotating disc platform for coins illustrating in phantom lines the position of coin guides on the underside of the guide plate shown in FIG. 2.

Referring to FIGS. 2 and 3, it will be noted that the underside of guide plate 16, which is generally flat, has three downwardly extending guides, being peripheral limit guide 34, single file guide 36, and coin release or exit guide 38. Guide plate 16 is positioned with respect to rotating disc 10 such that these guides extend down to the top flexible surface 26 of disc 10, leaving the other regions 40 with a clearance in which coins are free to move unimpeded by the guides. Thus, the guide surfaces generally have a thickness of approximately 0.08 to 0.085 inch, corresponding generally to the thickest coin to be sorted. Guide 36 functions to route coins from the central region 42 of disc 10 radially outward over a limited peripheral region of approximately 180 degrees where they would be stopped by an inner wall 44 of guide 38, and then as they are rotated, they would pass through a single file passageway 46 to form a single file on peripheral limit guide 34, this guide having a tapered edge 48 which effects a wedge action on the coins, stabilizing their movement against radial bounce, causing the coins to be moved circumferentially in a spaced format as shown about disc 10. Coins reaching passageway 46 which are not against inner wall 44, and thus not in a single file, are captured by tapered edge 47 (similar to that shown in FIG. 10), pressed into pad 27, and rotated back into the center of disc 10. Double layers of coins are prevented in the passageways between guides by maintaining a clearance (0.08 to 0.085 inch) between the flexible surface of disc 10 and upper surface 49 of plate 16 of less than the double thickness of the thinnest coins to be sorted, in the present case, dimes, which have a thickness of about 0.05 inch each. The coins continue in the circular direction indicated by arrow 49 until they reach coin release guide 38. As shown, coin release guide 38 contains four coin release slots, coin release slot 50 for dimes, coin release slot 52 for pennies, coin release slot 54 for nickels, and coin release slot 56 for quarters. The slots are of a width equal to or slightly larger than the diameter of such coins. As shown, the coins encounter progressively larger slots as they are rotated by disc 10 counterclockwise under coin release guide 38 by being compressed between the lower face 57 of guide 38 and the flexible surface of disc 10 and are released.

Assume first that a dime is the first coin in line approaching coin release guide 38, it having its outer edge against the inner edge 60 of turned-in guide extension 61 of guide 34. The coin thus engages with its inner edge the outer leading edge 62 of guide 38, which edge is tapered upward to gradually depress a coin and seize it. Thus, from points 64 to 68, the coin is wedged in a stabilized radial position until it reaches the full dime width of dime slot 50 where it is freed of vertical restraint and is thus free to follow the outwardly extending path of slot 50 which extends essentially normal to a radial line and thus to the edge of disc 10, enabling a dime to be ejected at a peripheral position or path 70 at which a coin sorting bag or outer receptacle (not shown) would be positioned.

Assume next that a larger coin, say, a penny, arrives at and strikes leading edge 62 of guide 38. Such coin will be captured by the outwardly extending edge of guide 38 between points 64 and 68 and continue to be captured by virtue of the fact that the inner edge of the coin will be forced inward of the inner edge of dime slot 50 by edge 60, and thus be wedged between the top surface of disc 10 and guide 38. This will cause the coin to be moved in a rotary pattern rather than to be free to move outward. The rotary movement of the coin continues until it strikes penny slot 52, and since slot 52 is of a width to accommodate a penny, a penny will be released from vertical pressure, and, by virtue of its momentum, it will be hurled outward in slot 52 along a path 72 where it would be intercepted by a penny sorting bag or receptacle (not shown). In a similar manner, larger coins, nickels and quarters, would be captured and sorted by slots 54 and 56, respectively, being intercepted by bags at path positions 74 and 76, respectively.

Figure 4:
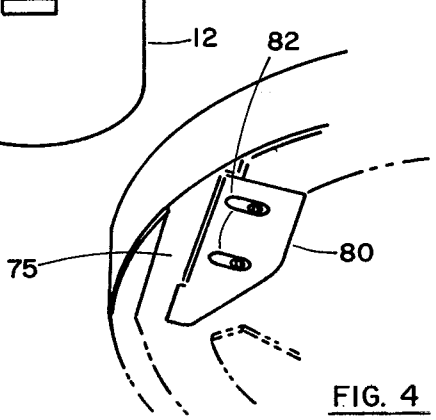
FIG. 4 is a broken pictorial view illustrating an adjustable coin release as contemplated by this invention.

FIG. 4 illustrates a coin release slot 78 formed by an adjustable guide member 80 which is movable in adjustment slots 82 to enable a coin release slot to be formed of any desired width. Such an adjustable slot assembly may be positioned as the first, intermediate, or last slot in a series, depending upon a desired range of adjustment. Similarly, it may be the only slot in an assembly where, for example, the sorter is to be employed as a coin verifier wherein it is only necessary that coins be routed in a single file from the device, enabling them to be hurled into space in a spaced single file where they can readily be counted by optical, electrical, or other conventional counting means.

Figures 5, 6, 7, 8, 9, 10:
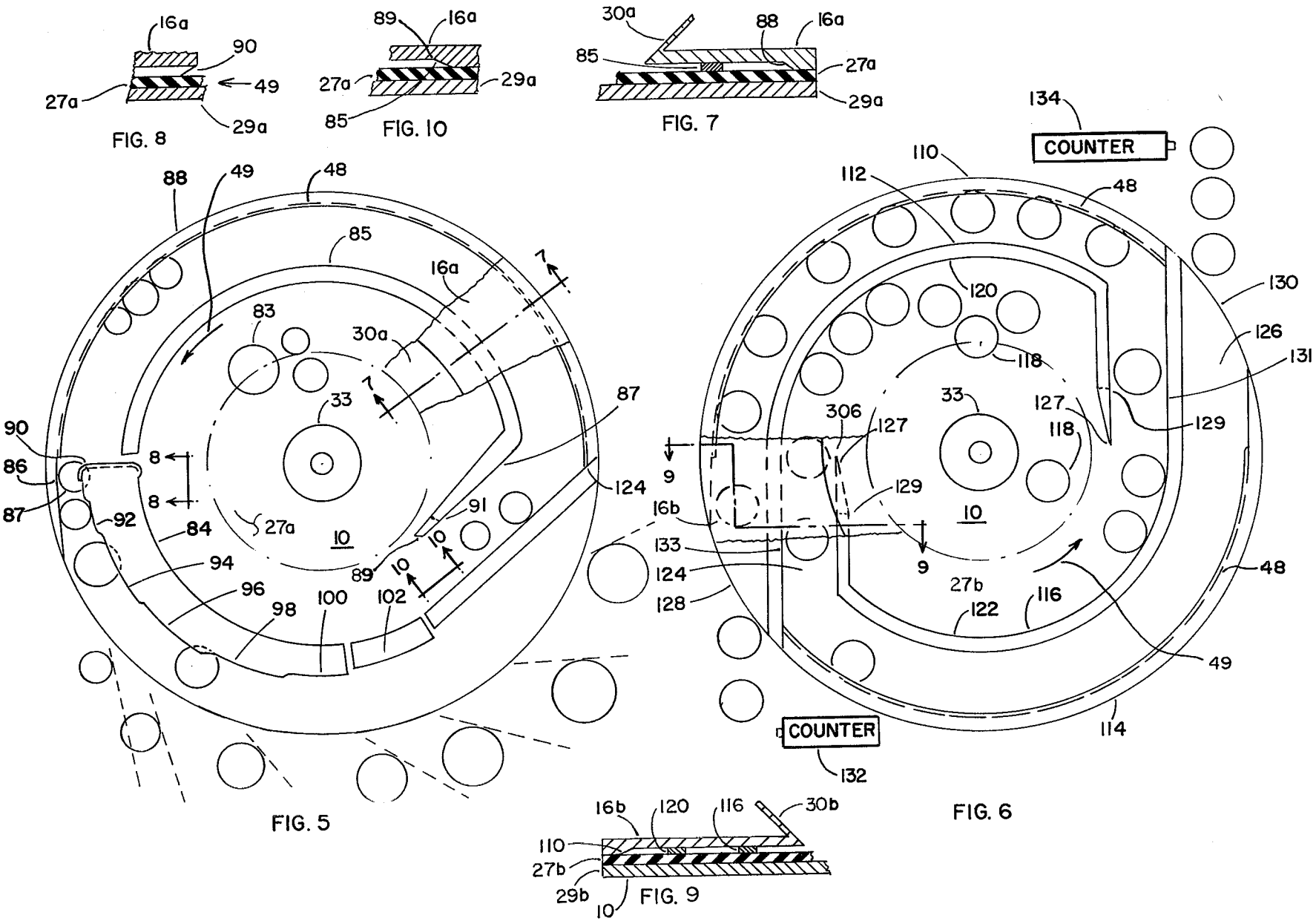
FIG. 5 is a plan view of a modification of this invention illustrated by a modified form of guide superimposed over a rotating disc.
FIG. 6 is a plan view of a further modification of this invention, particularly useful for coin count verifying illustrated by superimposing another form of guide assembly over a rotating disc.
FIG. 7 is a sectional view along lines 7—7 of FIG. 5.
FIG. 8 is a sectional view along lines 8—8 of FIG. 5.
FIG. 9 is a sectional view along lines 9—9 of FIG. 6.
FIG. 10 is a sectional view along lines 10—10 of FIG. 5.

FIG. 5 illustrates a further and simplified form of construction of the invention, showing the guide plates as they would be seen if viewing them vertically downward and without the flat supporting guide plate structure, except as briefly shown in broken form in section views thereof in FIGS. 7 and 8. Generally, circular guide member 85, shown in FIG. 7, blocks the exit of coins from the center of disc 10 except through a single file passageway 87, leading edge 89 thereof being tapered, as shown in FIG. 10, to capture any coins tending to be stopped by the leading edge of guide 85, causing any such coins to be rotated back into the center of disc 10. The basic change illustrated by this embodiment of the invention is in the form of the coin release guide, illustrated by coin release guide 84. The leading edge 90 of this guide is illustrated in FIG. 8 as a part of top plate **16*a* (broken), illustrating that a coin carried in the direction 48*a* on pad 27*a* would be forced down into pad 27*a* and be captured and rotated in an arc having a discrete radius as defined by the captured coin. FIGS. 7 and 8 also illustrate that pad 27*a* is supported on circular plate 29*a*, typically secured in place by conical hub 33**.

In contrast to guide 38 shown in FIG. 3, guide 84 of FIG. 5 has only a series of progressively shortest radiused outer edges. Thus, for example, a dime 87 would be captured between outer guide 86, an extension of peripheral stop guide 80, and leading edge region 90 of guide 84 until that coin of coins 83 reaches the indentation 92, at which point a dime would be freed from restraint and would be hurled outward in the same manner as described above.

Coins larger than a dime would be initially secured in the same manner and would continue rotation in a circular pattern on disc 10 until released by one of the coin release indentations 94, 96, 98, 100, 102, or 104, each being of progressively shorter radius to progressively release larger coins as they travel counterclockwise. If desired, the device may be made to operate clockwise by reversing the arrangement of the guides. The actual number and outer edge radius of the releases are dependent upon the number and diameter of coins to be released. It is only necessary that the dimension between guide edge 90 and guide edge 86 be smaller than the smallest coin to be released in order to initially capture a coin. Coin release 102 is shown as being discrete from coin release guide 84 as an example of a removable or an interchangeable guide to accommodate a selected coin size greater than the size released by release edge 100. Coin release 104 also serves as an extension of guide 84 to prevent coins from escaping from the center of the coin sorter except by the release route described.

Guide 106 guides coins from the center of disc 10 onto the inner edge of guide 88 to form a single file as in the case of guide 36 of the embodiment shown in FIGS. 2 and 3.

FIG. 6 illustrates a coin verifier, a device which functions to arrange coins in a single file and then count them, the purpose being to determine the accuracy of a count of coins in some container. A device of the type illustrated in FIG. 6 would have the same drive system, rotating disc, top supporting plate, and hopper as shown in FIG. 1. This general arrangement is partially illustrated in the section view shown in FIG. 9 illustrating the relationship of hopper **30*b*, top plate 16*b***, and pad 26*b* on steel rotating plate 29*b* of disc 10. The guide configuration is different as shown in FIGS. 6 and 10. Except where broken for purposes of the section view, FIG. 6 shows only the downward extensions of plate 16*b* which form, in this case, peripheral limit guides 110 and 114, which are identical, and inner guides 112 and 116, also being identical. It would differ in that the guides which extend down from the top, flat, supporting guide plate 160 would be configured as shown in FIG. 6 wherein only the relief surface of the top supporting plate as shown in the form of guides 110, 112, 114, and 116 would be employed. Thus, as shown, coins 118 placed on disc 10 through hopper 30 (FIG. 1) would radiate outward against inner edges 120 and 122 of guides 110 and 116, and then would be routed through passageways 124 and 126 to form a single file which is edged against flexible pad 27*b* by guides 110 and 114, having a tapered configuration as shown in FIG. 9. This prevents bounce and increases speed of operation. Thus, coins would be rotated in a single file until they come to exits 128 and 130 where they would be hurled along a line outward to be intercepted or passed by counters 132 and 134, which would count them. Identical leading edges 127 of guides 112 and 116 are tapered back to point 129 similar to the tapering of guide 85 as shown in FIG. 10 so that any tendency of two coins wedged together between guides at the entrance to passageways 131 or 133 is prevented by the inner of such coins being captured under this tapered edge of the guide and the coin rotated back into the center region of the disc. A counter may be of a type employing light, radiation, magnetic, or another form of conventional sensing to effect counting. After leaving counters 130 and 132, coins would be fed to coin bags (not shown).

While the coin verifying device shown in FIG. 6 illustrates two verifying paths, a single one may be effected by making guides 110 and 114 continuous, omitting, for example, passageway 126 and making guides 116 and 112 circularly continuous and leaving a single exit 128.

It is to be noted that in contrast to previous verifiers, the present verifier needs no adjustment to verify different size coins. Further, by making the counters selective insofar as the denomination of coin counted is concerned, a monetary value count of coins passing through the verifier may be achieved, or the detection of "off" denomination coins which were unintentionally mixed may be achieved.

Having thus described our invention, what is claimed is:

1. A coin handling device comprising:

a horizontally positioned rotating disc having a resilient upper surface over at least an outer annular portion of said disc;

an annular horizontal guide plate centrically positioned above said rotating disc and generally having a flat surface over said disc at a selected height, said height being approximately the width of the thickest coin to be handled, and extending there below:

at least one horizontal stationary peripheral limit guide extending downward to approximately the resilient surface of said disc and horizontally extending only part way around an outer region of said disc, and having a tapered inner edge to effect a wedging action on coins against said flexible surface of said disc, and at least one horizontal, generally arcuate inner guide above said disc and extending down approximately to the surface of said disc, and having a radius smaller than that of said peripheral limit guide and being circumferentially spaced from said peripheral limit guide; and at least one exit guide above said disc and extending downward at a taper to approximately the surface of said disc, said direction of extension being measured with respect to the direction of rotation of said disc, and said exit guide being located just beyond, measured along the direction of rotation of said disc, said inner guide;

whereby a coin striking the tapered region of said exit guide is gradually pressed down into the resilient surface of said disc and held at a corresponding radial position until rotated beyond engagement by said exit guide, and a coin passing radially outward of said exit guide is free to be hurled by centrifugal force from said disc to an exit at an end of said peripheral limit guide.

2. A coin handling device as set forth in claim 1 further comprising counting means operatively positioned with respect to said exit for counting coins exiting said disc.

3. A coin sorter for sorting selected diameter coins comprising:

a horizontally positioned circular coin carrying disc having a top surface to which coins may be fed and having at least an annular surface of said surface which is resilient;

stationary, with respect to rotation of said disc, guide means including an inner facing guide surface around said disc for a selected arc, less than 360° to a point of termination, said point being referenced with respect to the movement of a coin on said disc along said guide surface, for horizontally positioning coins in a single file, with their outer edge against said guide surface at a fixed radial position, and their inner edge also at a fixed radial position;

radial position retention release guide means over said annular surface including a downward facing stationary surface area which extends, from adjacent to said termination point of said guide surface of said guide means, in the general direction of rotation of said disc, initially extending downward to approximately the surface of said disc and continuing in a curve about the center of said disc, whereby coins initially held at a radial position by said guide means are captured at a radial position by said guide means, by being pressed between said guide surface of said release guide means and resilient surface of said disc; and a plurality of radially outer coin release edges, said edges being generally spaced along the curve of said release guide, in the direction of rotation of said disc, each successive coin release edge being less distant from the center of said disc than the preceding coin release edge, whereby, when a coin is rotated at a fixed radial position by virtue of being compressed between said downwardly facing surface area and said disc, reaches a radial position wherein, by virtue of its diameter, its inner positioned edge has been moved over the edge of one of said release edges, it is no longer so pressed, the coin is freed, and by virtue of centrifugal force, the coin moves horizontally off of said disc at a discrete circumferential position.

4. A coin sorter as set forth in claim 3 wherein said release guide means includes a generally arcuate inner edge against which coins moving outward from the center of the disc strike and are guided to said first-named guide means as they are rotated by said disc.

5. A coin sorter as set forth in claim 3 wherein said guide means includes a second, generally arcuate, guide member having an inner edge and positioned adjacent to said disc and spaced between the center region of said disc and said first-named guide means, whereby coins may be initially directed onto an inner edge of said guide member, then onto an inner edge of said release guide means, and then onto said first-named guide means.

6. A coin sorter as set forth in claim 3 wherein a first end of said guide member extends approximately to said leading edge of said release guide means, whereby coins moving along said first-named guide means are directed to said release guide means.

* * * * *